US006896786B1

(12) United States Patent
Lausser et al.

(10) Patent No.: US 6,896,786 B1
(45) Date of Patent: May 24, 2005

(54) METHOD AND DEVICE FOR PRODUCING WEAR RESISTING SURFACES

(75) Inventors: Christof Lausser, Bad Homburg (DE); Hans-Jürgen Lauth, Neu-Anspach (DE)

(73) Assignee: LuK, Fahrzeug-Hydraulik GmbH & Co. KG, Bad Homburg (DE)

( * ) Notice: Subject to any disclaimer, the term of this patent is extended or adjusted under 35 U.S.C. 154(b) by 0 days.

(21) Appl. No.: 09/787,045

(22) PCT Filed: Sep. 14, 1999

(86) PCT No.: PCT/EP99/06800

§ 371 (c)(1),
(2), (4) Date: Jun. 21, 2001

(87) PCT Pub. No.: WO00/15877

PCT Pub. Date: Mar. 23, 2000

(30) Foreign Application Priority Data

Sep. 16, 1998 (DE) ..... 198 42 284

(51) Int. Cl.[7] ..... C25D 21/10

(52) U.S. Cl. ..... 205/148; 204/237; 204/275.1; 205/96; 205/131; 205/133; 205/151; 205/172; 205/175; 205/324; 428/469

(58) Field of Search ..... 205/96, 131, 133, 205/148, 151, 172, 175, 324; 204/237, 275.1; 428/469

(56) References Cited

U.S. PATENT DOCUMENTS 5,792,265 A 8/1998 Maier et al. ..... 118/317
6,261,433 B1 * 7/2001 Landau ..... 205/96

FOREIGN PATENT DOCUMENTS

DE 1 909 870 2/1969
DE 43 37724 A1 11/1993

OTHER PUBLICATIONS

Alfred Schmidt, Vertag Chemie, 1976 p. 51–54 German Article Titled "Applied Electrochemistry",no month given.

* cited by examiner

*Primary Examiner*—Robert R. Koehler
(74) *Attorney, Agent, or Firm*—Morriss O'Bryant Compagni, P.C.

(57) ABSTRACT

A process for the production of wear-resistant, coated surfaces includes the use of at least two electrodes connected to a voltages source which are mounted in, or border, a reaction space through which an electrolyte flows in which the surface to be coated is located. The process is distinguished by the fact that the direction of the flow of the electrolyte is selectively reversed at least once during the coating process to enable better control of the formation of the oxide layer.

21 Claims, 2 Drawing Sheets

METHOD AND DEVICE FOR PRODUCING WEAR RESISTING SURFACES

RELATED APPLICATIONS

The present application is the U.S. National phase of PCT/EP99/06800, filed Sep. 14, 1999, which claims priority to German Patent App. No. 19842284.9.

BACKGROUND

The invention relates to a process for the production of wear-resistant, coated surfaces. Processes of the type addressed here are known. They serve for example to provide a surface consisting of aluminum or an aluminum alloy, for example the surface of a hole, with an oxide layer. To carry out the prior-art coating process the workpiece is connected to the positive pole of a voltage source, therefore forming the anode. A lead plate connected to the negative pole forms the cathode which is introduced into the hole. An electrolyte, here diluted sulfuric acid, is conducted into the chamber bordered by the workpiece and the cathode. The chamber has an inlet and an outlet and the electrolyte flows through in one direction. It has been proven disadvantageous that the thickness of the aluminum oxide layer is different over the surface to be coated, that is, on one side of the workpiece the thickness of the oxide layer is greater than on the other side. Thereby desired tolerances in the form of the surface can be adhered to in all cases so that the coated surface must be reworked, for example, by grinding or honing in order to achieve a high precision in form and dimensions.

DE 1 909 870 describes a process for the galvanic deposition of metals on the outer and inner surfaces of porous metallic, or premetallized non-metallic, formed bodies. It was discovered that on the outer as well as on the inner metallic surfaces of a porous formed body a nearly uniform galvanic deposition of metal can be achieved if the electrolyte is pressed through the pores of the formed body serving as electrode at a certain rate, preferably at a rate of 80 to 130 cm/sec. If the formed body is very thick-walled, then a reduction of the layer thickness of the metal deposit in the direction of flow of the electrolyte is observed. By timed reversal of the direction of flow of the electrolytes and by arrangement of two anodes this disadvantage can be eliminated.

SUMMARY AND OBJECT OF THE INVENTION

It is the objective of the invention to provide a process of the type stated initially which does not have the disadvantages described initially.

For the realization of the objective of the invention, the process of the present invention comprises a method where the direction of flow of the electrolyte during the coating process is reversed at least once. By the reversal of the direction of flow of the electrolyte at a preferably precisely defined point in time a specific effect on the distribution of the thickness of the layer and the desired theoretical dimensions is possible, that is, the thickness of the wear-resistant layer generated by the electrolyte can be adjusted. Thereby the form of the surface to be coated, therefore, for example, the conicity of a hole or the planeness of a plate can be influenced.

The surface to be coated consists of aluminum or an aluminum alloy. An oxide layer is formed thereon which is also designated as anodizing layer. This form of electrolysis is also designated as anodizing or anodic oxidation in which the workpiece to be coated serves as anode and a, for example lead, plate serves as cathode, both being introduced into a reaction space or bordering it. An electrolyte, for example diluted sulfuric acid, flows through the reaction space. The anodizing layer generated by the anodizing is hard and very resistant to the influence of chemicals.

In an advantageous form of embodiment of the process the surface to be coated is curved, in particular cylindrical, or plane. By the deliberate reversal of the direction of flow of the electrolyte the form and/or the theoretical dimension can therefore be influenced in the case of curved as well as plane surfaces. The process according to the invention is particularly advantageous in the coating of a passageway or a sack hole on whose precision of form and dimension high demands are made, such as, for example, a hole for a valve piston of a conveyance device used in a vehicle. In many cases a hole has a conical form instead of a cylindrical one after its completion, which can be compensated or eliminated by the deliberate reversal of the direction of flow of the electrolyte during the coating of the surface. Furthermore, the form of plane surfaces can be intentionally changed, in particular adjusted, with the aid of the above-described process by influencing the distribution of the thickness of the layer. Thereby plane surfaces can be produced which have a high precision of dimension.

An apparatus for carrying out the process includes a reaction space connected to at least two connecting lines of which a first connecting line serves as inlet and a second connecting line serves as outlet for an electrolyte which can be transported by means of a feed line. The workpiece to be coated or the at least one surface is introduced into the reaction space and at least brought into contact with the electrolyte. It is also possible that the workpiece borders or forms a part of the reaction space. This is, for example, possible in the case of a workpiece with a hole to be coated. An electrode is introduced into the hole whose surface is intended to be coated. At least one anode is located in the reaction space and a cathode or the workpiece is connected to one of the two poles of the voltage source and thus forms the anode or the cathode. The apparatus is distinguished by the fact that in the path of flow of the electrolyte a change-over device, for example, a valve, is provided with whose aid the inlet and the outlet can be interchanged. With the aid of the manually or automatically switchable change-over device a reversal of the direction of flow of the electrolyte through the reaction space at a definite point in time is possible so that a constant layer thickness or different layer thickness can be realized on the surface to be coated. Thereby the form of the surface, for example that of the hole, plate, or the like can be influenced. The inlet and the outlet are in the case of a preferred exemplary embodiment connected to the reaction space at a distance from one another in such a manner that the electrolyte preferably flows by on the entire, at least however on a large part, of the surface to be coated.

Additional advantageous forms of embodiment follow from the remaining subordinate claims.

BRIEF DESCRIPTION OF THE DRAWINGS

The invention will be explained in more detail in the following with the aid of the drawings.

FIG. 1 shows a schematic sketch of a first exemplary embodiment of an apparatus 1 for the production of wear-resistant, coated surfaces, here of a cylindrical, or essentially cylindrical, sack hole 5 introduced into a workpiece 3. A rod-like electrode 7, connected to a voltage source not represented, is inserted into the sack hole 5, said electrode having a first longitudinal section 9 of greater diameter and a second longitudinal section 11 of lesser diameter. The diameter of the electrode 7 in the area of the first longitudinal section 9 corresponds essentially to the diameter of the sack hole 5 while the diameter of the second longitudinal section 11 is smaller than that of the sack hole so that between the sack hole 5 and the electrode 7 an annular space is formed in the area of the second longitudinal section 11. In the area of the longitudinal section 11 there is introduced in the outer circumferential surface of the electrode 7 an encircling indentation in which a seal 13 is disposed with whose aid the sack hole 5 is sealed against the environment. The opening of the sack hole 5 is therefore sealed by the electrode 7, whereby a closed chamber forming a reaction space arises.

Figure 1:
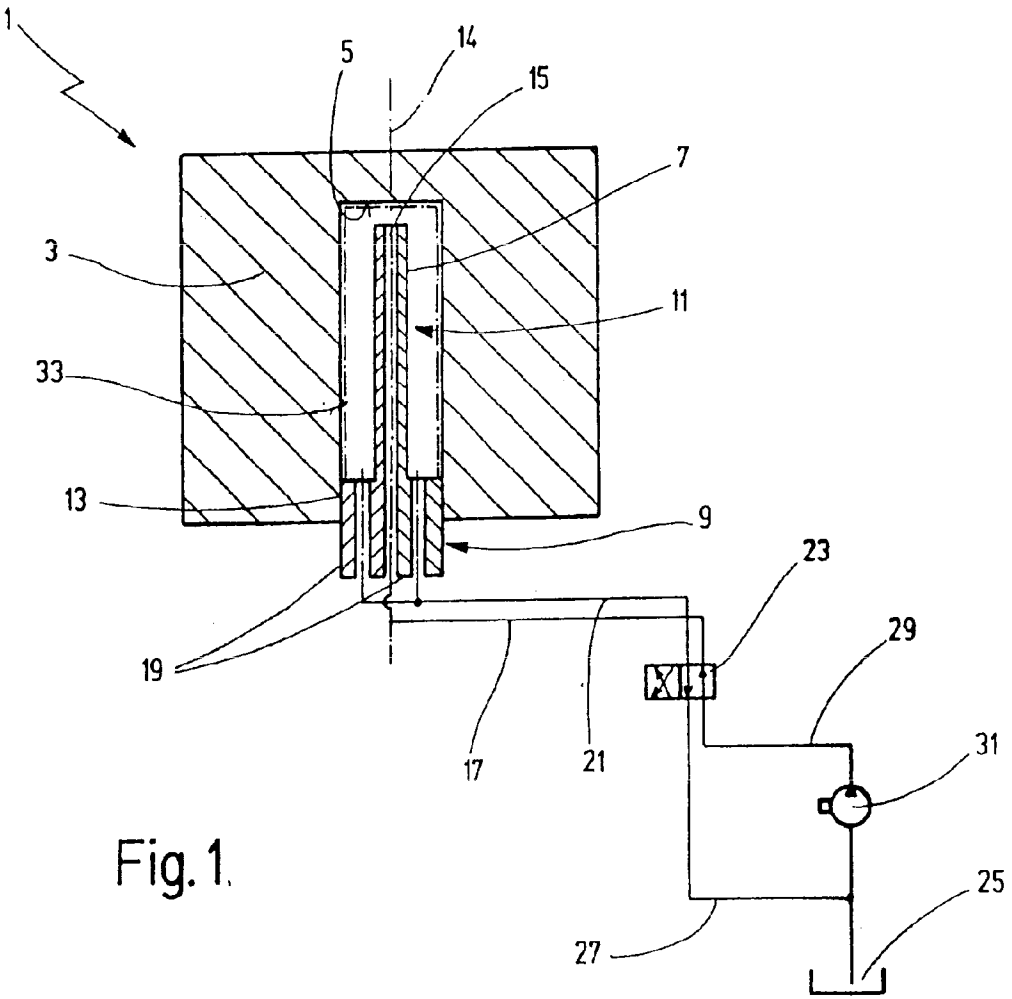
FIG. 1 shows a schematic view of one exemplary embodiment of an apparatus of the present invention, for use in oxidizing a working surface is oxidized in accordance with the principles of the present invention.

In the electrode 7 a passageway opening 15 is introduced disposed concentrically to the electrode's central longitudinal axis 14, said passageway opening being connected to a first connecting line 17 at its end opposite the base of the sack hole 5. In the area of the first longitudinal section 9 two additional passageway holes 19 disposed at a distance from the central longitudinal axis 14 are introduced into the electrode 7 which are connected to a second connecting line 21. The connecting lines 17 and 21 are connected to a change-over device which is formed here by a 4/2-way valve 23. A return line 27 leading to a container 25 for an electrolyte and a feed line 29 also connected to the container 25 are connected directly to the valve 23. Furthermore, a feed line formed here by a pump 31 is provided, said feed line sucking the electrolyte out of the container 25 and feeding it via the feed line 29, the valve 23, and one of the connecting lines 17 or 21 to the sack hole 5. The construction and the function of a 4/2-way valve 23 is known in itself so that this will not be described in more detail. The development from the standpoint of construction of the change-over device, formed here merely by way of example by a valve, can vary. What is important is that with the aid of the change-over device the direction of flow of the electrolyte in the reaction space be can be reversed.

In the following it is assumed that the workpiece 3 consists of aluminum or an aluminum alloy and that the apparatus 1 serves for the hard anodizing of the surface of the sack hole 5. In this electrolysis process the workpiece 3 serves as anode and is connected for this purpose to the positive pole of the voltage source while the electrode 7 projecting into the sack hole 5 and consisting, for example, of lead is connected to the negative pole of the voltage source and therefore serves as cathode. As the electrolyte in this process, for example, diluted sulfuric acid can be used.

In the functional position represented in FIG. 1 of the four connections and valve 23 having two switch settings the electrolyte is sucked out of the container 25 by means of the pump 31 and is brought via the feed line 29, the first connecting line 17, and the passageway opening 15 introduced in the central area of the electrode 7 into the annular space bordered by the sack hole 5 and the electrode 7 and sealed against the environment. The electrolyte exiting from the passageway opening 15 directly over the base of the sack hole 5 flows along the electrode 7 or the surface of the hole in the direction of the sack hole's opening sealed by the first longitudinal section 9 of the electrode 7 and is returned via the two passageway holes 19, the second connecting line 21, and the return line 27 into the container 25. At a precisely defined point in time the valve 23 is set manually or automatically in its second functional position. Thereby the direction of flow of the electrolyte is reversed, that is, the connecting line 17 is connected to the return line 27 and the second connecting line 21 is connected to the feed line 29. The electrolyte fed by the pump 31 from the container 25 then enters the sack hole 5 through the passageway holes 19, flows along the surface of the hole in the direction of the base of the sack hole, and is returned via the passageway opening 15 in the electrode 7, the first connecting line 17, and the return line 27 into the container 25.

With regard to the function of the electrolysis process let it be noted that for some time DC current flows through the bath, i.e., through the electrolyte, which flows through the reaction space bordered by the sack hole or the chamber closed against the environment. Thus, oxygen arises at the anode, here therefore at the surface of the hole, said oxygen reacting with the aluminum to form an adhesive oxide layer ($Al_2O_3$), the so-called anodizing layer. By the appropriate choice of the point in time of the reversal of the direction of flow of the electrolyte the distribution of the thickness of the layer, i.e., the thickness of the hard anodizing surface 33 represented in FIG. 1 with a dotted line, can be definitely influenced. Thereby it is possible to compensate a conicity of the sack hole 5 which, for example, is present at the completion of the sack hole 5. That is, through the at least one reversal of the direction of flow of the electrolyte at a definite point in time during the coating process it is achieved that the oxide layer has a smaller thickness at the hole's end having the smaller diameter than at the other end having the greater diameter. The conicity of the hole, which is, for example, 6 $\mu$m at a length of the hole of 40 mm to 50 mm, can be compensated thereby so that the hole has a cylindrical form after the coating process.

From all of this it follows without further efforts for the process described that it can be used advantageously in particular wherever a high precision of form and/or dimension of the surface to be coated is required, for example, in valve piston holes in a hydraulic conveyance device, for example, a power steering pump for a vehicle.

Figure 2A:
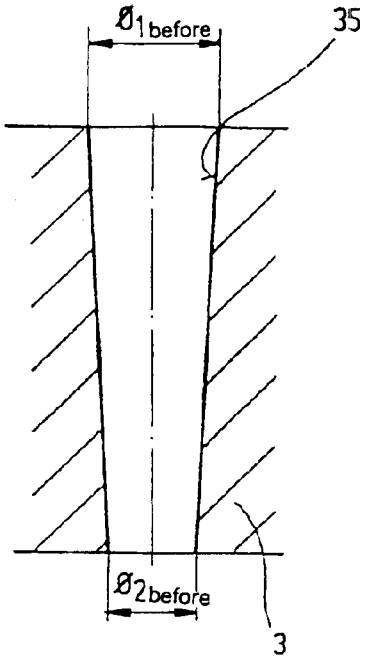
FIG. 2A shows a cross-sectional view of a hole being coated in accordance with the principles of the present invention.
Figure 2B:
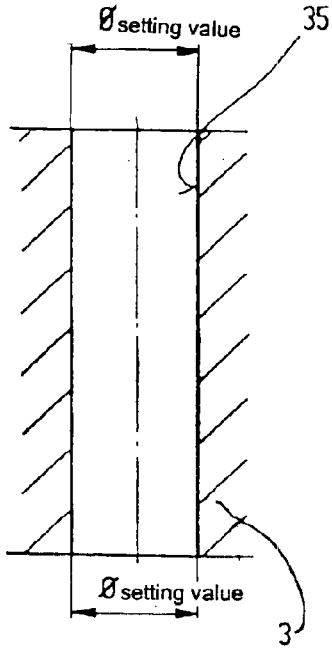
FIG. 2B shows a cross-sectional view of a hole being coated in accordance with the principles of the present invention.
Figure 2C:
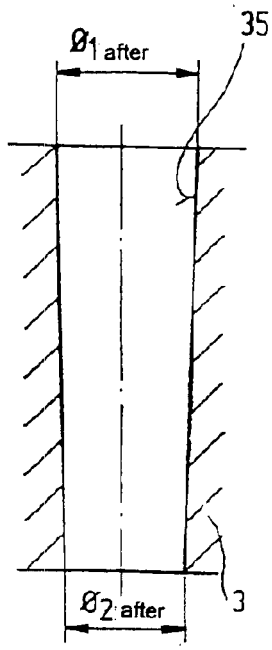
FIG. 2C shows a cross-sectional view of a hole being coated in accordance with the principles of the present invention.

The determination of the times for the individual flow directions, therefore the determination of the points in time of reversal of the direction of flow of the electrolyte, can be done by calculation as well as empirically by a comparison of the diameter of the hole before and after the hardening process. In the following a method for the determination of the point in time of reversal of the direction of flow or the period of time of the individual flow directions will be explained in more detail with the aid of FIGS. 2A to 2C, each of which shows a part of a workpiece 3 in the area of a passageway hole 35. In FIG. 2A the passageway hole 35 is represented after its production but before the hard anodizing and in FIG. 2C after the hard anodizing. In FIG. 2B the passageway hole 35 is represented with its desired theoretical diameter and cylindrical form. To carry out the above-described process for the production of wear-resistant, coated surfaces an apparatus not represented in the FIGS. 2A to 2C is used whose layout is different from that described with the aid of FIG. 1 with the aim that the connecting lines connected to the return line leading to the container and to the feed line connected to the pump, said connecting lines forming the inlet and outlet for the electrolyte, are each connected to an opening of the passageway hole 35.

As can be seen from FIG. 2A the passageway hole 35 has a conical form after its production, that is, the diameter of the passageway hole is different in the area of its openings. One diameter is designated by $Ø_{1before}$ and the other with $Ø_{2before}$. After the preprocessing of the passageway hole 35 the theoretical diameters $Ø_{1before}$ and $Ø_{2before}$ are measured and from this the anodizing time is determined or calculated by means of the following equation:

$$\Delta Ø = Ø_{setting\ value} - K(Ø_1 + Ø_2)/2,$$

where K is a parameter or a constant which can be determined empirically or by calculation. After the coating of the passageway hole 35 the theoretical diameters $Ø_{1after}$ and $Ø_{2after}$ are determined. The times for the individual directions of flow are determined or calculated from the difference $Ø_{before} - Ø_{after}$. As represented in FIG. 2C, the difference in diameter between $Ø_{1after}$ and $Ø_{2after}$ is smaller than before the coating process. The conicity is therefore substantially compensated in the case of this examplary example. The conicity can be compensated by the above-described process at least better than is possible by the prior-art production processes designated as Dalic processes.

Figure 3A:
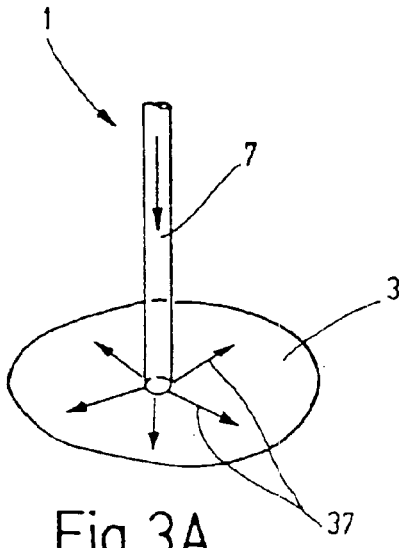
FIG. 3A shows a perspective view of an additional exemplary embodiment of the apparatus in accordance with the present invention.
Figure 3B:
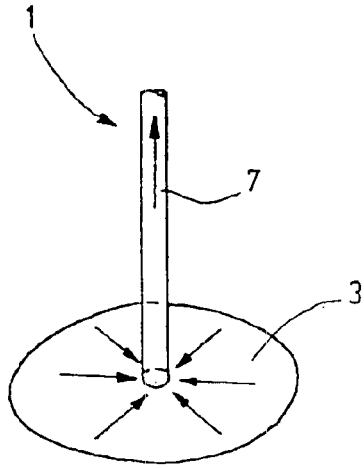
FIG. 3B shows a view similar to that of FIG. 3A with the flow reversed.

FIGS. 3A and 3B each show a perspective view of a part of an additional exemplary embodiment of the apparatus 1 in which the work piece 3 is a plate whose plane or essentially plane surface is to be provided with an oxide layer. The tubular electrode 7 forming the cathode is held for this purpose perpendicular or essentially perpendicular and at a distance from the workpiece 3 which is located in a reaction space, for example in a bath through which an electrolyte can flow. In the coating process the liquid electrolyte, for example sulfuric acid, is applied for a definite period of time via the passageway opening in the electrode 7 to the surface of the workpiece 3 to be coated (FIG. 3A). The electrolyte is incident essentially in the middle of the plate and flows from there, as indicated with arrows 37, in the direction of the lateral edge of the workpiece 3. At a desired point in time, determined empirically or by calculation, the direction of flow of the electrolyte is reversed so that it flows from the lateral edge of the plate-like workpiece 3 into its center and is returned via the passageway opening in the electrode 7 into the container.

Through the adjustable period of time of the individual directions of flow the form of the plane surface of the workpiece 3 can be influenced and the thickness of the layer can be adjusted in the edge area as well as in the central area of the workpiece 3. Thereby unevenness on the surface to be coated can be compensated.

From all this it is clear that in connection with the present invention a closed chamber as well as a bath is understood by the term "reaction space."

In summary it remains to be determined that, with the above-described process, the thickness of the layer generated in the coating process can be influenced for curved as well as plane surfaces. By the control of the distribution of the thickness of the layer a specific effect on the form of the coated surface is furthermore possible. The development of the apparatus for the production of coated surfaces, for example the form of the electrode forming the cathode during hard anodizing, the inlet connection and the outlet connection for the electrolyte, and the like are adapted to the form of the surface to be coated and/or the workpiece. Through the exact distribution of the thickness of the layer a reworking of the coated surface in order to obtain a desired form and/or an exact dimension, can be omitted in given cases since these parameters can be set sufficiently precisely by the precise control of the period of time of the directions of flow of the electrolyte in many cases.

What is claimed is:

1. A process for the production of wear-resistant, coated surfaces with at least two electrodes, connected to a voltage source, which are disposed in or are adjacent a reaction space through which an electrolyte flows and in which the surface to be coated is located, the process comprising:

providing a workpiece having a surface to be coated;

exposing said surface of said workpiece to the flow of an electrolyte, said electrolyte flow being in a defined direction;

selectively reversing the flow of the electrolyte at least once during the coating process to provide said surface of said workpiece with a coating of selected thickness and form; and thereby forming an oxide layer ($Al_2O_3$) on a said surface.

2. The process according to claim 1, wherein the method comprises reversing flow based on precalculated flow times.

3. The process according to claim 1, wherein said defined direction of flow of said electrolyte is determined as a function of the form of said surface of the said workpiece before the coating process.

4. The process according to claim 1, wherein said surface of said workpiece to be coated is curved.

5. The process according to claim 1, wherein said surface of said workpiece for coating is planar.

6. The process according to claim 1, wherein the method comprises selectively reversing said electrolyte flow to develop different layer thicknesses on said surface to be coated.

7. The process according to claim 1, wherein the method comprises selecting a workpiece having a conically-shaped void formed therein and selectively reversing the flow of electrolyte to form an oxide layer defining a generally cylindrical void.

8. The process according to claim 1, wherein the method comprises disposing at least two connecting lines in communication with the working surface, where a first connecting line serves as the inlet and a second connecting line serves as the outlet for the electrolyte which can be transported with the aid of a feed line and at least two electrodes, connected to a voltage source, which are disposed in communication with the reaction space, and a change-over device for selectively reversing flow through the inlet and the outlet.

9. The process according to claim 8, wherein the method comprises forming one electrode from the surface to be coated.

10. The process according to claim 1 wherein said surface to be coated is comprised of aluminum or aluminum alloy such that an oxide layer is formed thereon.

11. An apparatus for the production of wear-resistant surfaces having a reaction space connected to at least two connecting lines where a first connecting line serves as the inlet and a second connecting line serves as the outlet for an electrolyte which can be transported with the aid of a feed line, and at least two electrodes, connected to a voltage source, which are disposed in communication with the reaction space, and a change-over device for selectively reversing flow through said inlet and said outlet.

12. The apparatus according to claim 11 wherein at least one electrode is formed from a surface to be coated, said surface being selected from the group consisting of aluminum and an aluminum alloy.

13. The apparatus according to claim 12, wherein said surface to be coated is curved.

14. The apparatus according to claim 12, wherein said surface to be coated is cylindrical.

15. The apparatus according to claim 12, wherein said surface to be coated defines a plane.

16. A process for the production of wear-resistant coated surfaces, comprising:

providing an electrolytic apparatus comprising a reaction space through which an electrolyte is flowable, at least two electrodes connected to a voltage source and disposed adjacent to or in said reaction space;

providing a workpiece having a surface to be coated;

placing said surface to be coated in said reaction space;

directing the flow of an electrolyte through said reaction space in a defined direction; and selectively reversing the flow of said electrolyte at least once during the coating process to form a coating on said surface of selected thickness and form.

17. The process as set forth in claim 16 wherein said workpiece is configured with an opening therethrough having a first end with a diameter $Ø_1$ and a second end with a diameter $Ø_2$ and an inner surface to be coated extending between said first end and said second end, and wherein the time for coating said surface is determined by the equation:

$$\Delta Ø = Ø_{setting\ value} - K(Ø_1 + Ø_2)/2,$$

where $Ø_{setting\ value}$ is the selected diameter thickness and K is a constant.

18. The process as set forth in claim 17 wherein $Ø_1$ does not equal $Ø_2$ before and after the coating process.

19. The process as set forth in claim 17 wherein $Ø_1$ does not equal $Ø_2$ before the coating process and $Ø_1$ and $Ø_2$ are equal after the coating process.

20. The process as set forth in claim 16 wherein said surface to be coated is connected to said electrolytic apparatus as the anode.

21. The process as set forth in claim 16 wherein said surface to be coated is formed from aluminum or an alloy thereof.

* * * * *